US005504311A

United States Patent [19]

DuBuis et al.

[11] Patent Number: 5,504,311

[45] Date of Patent: Apr. 2, 1996

[54] MICROWAVE OVEN WITH OPTICAL DETECTOR

[76] Inventors: Jean-Charles DuBuis, 14 Rue des Glairaux, 38524 Saint Egreve, France; Nils Kongmark, 62 de Ruyterkade, Curacao, Netherlands Antilles

[21] Appl. No.: 108,707

[22] PCT Filed: Mar. 10, 1992

[86] PCT No.: PCT/FR92/00214

§ 371 Date: Dec. 6, 1993

§ 102(e) Date: Dec. 6, 1993

[87] PCT Pub. No.: WO92/16083

PCT Pub. Date: Sep. 17, 1992

[30] Foreign Application Priority Data

Mar. 11, 1991 [FR] France ..... 91 03148

[51] Int. Cl.[6] ..... H05B 6/68

[52] U.S. Cl. ..... 219/714; 219/720; 219/506; 219/763; 99/325

[58] Field of Search ..... 219/714, 720, 219/506, 763; 358/93; 340/706, 711; 235/375, 462; 99/325

[56] References Cited

U.S. PATENT DOCUMENTS

| | | | |
|---|---|---|---|
| 4,323,773 | 4/1982 | Carpenter | 219/714 |
| 4,628,351 | 12/1986 | Heo | 219/720 |
| 4,711,979 | 12/1987 | Glasser et al. | 219/714 |
| 4,780,588 | 10/1988 | Edamura | 219/714 |
| 4,814,571 | 3/1989 | Bowen et al. | 219/763 |
| 5,011,042 | 4/1991 | Bunce et al. | 219/714 |
| 5,274,209 | 12/1993 | Edamura | 219/714 |

FOREIGN PATENT DOCUMENTS

| | | | |
|---|---|---|---|
| 3702587 | 8/1988 | Germany . | |
| 3196180 | 12/1988 | Japan . | |
| 1003420 | 4/1989 | Japan . | |
| 1025117 | 5/1989 | Japan . | |
| 1213778 | 11/1989 | Japan . | |
| 2025635 | 4/1990 | Japan . | |
| 2-133711 | 5/1990 | Japan | 219/714 |
| 2306028 | 3/1991 | Japan . | |
| 1180958 | 2/1970 | United Kingdom . | |
| 2185840 | 7/1987 | United Kingdom . | |
| WO90/03719 | 4/1990 | WIPO . | |

*Primary Examiner*—Philip H. Leung
*Attorney, Agent, or Firm*—Young & Thompson

[57] ABSTRACT

Control device for controlling a heating apparatus, such as a microwave oven. The microwave oven has a housing 12, an enclosure 16 in which a drawer 14 that receives a product to be heated slides, the microwave oven being actuated by a handle 15 and has optical and/or optoelectronic devices 21, 22 to read a distinctive sign 6 on either the product or its packaging. A processing module 30 is included to compare signals generated from reading this distinctive sign 6 with predetermined reference signals memorized in a storage device, and a supply module 43 generates operational control signals for the heating apparatus 10 in response to the result of this comparison. The optical and/or optoelectronic devices 21, 22 have a receiving cell 22 situated at the inlet and on the upper surface of the enclosure 16, the optical and/or optoelectronic devices being energized when the drawer 14 is pushed into the enclosure 16 to thereby effectuate a reading of the distinctive sign 6 on the product to be heated.

7 Claims, 1 Drawing Sheet

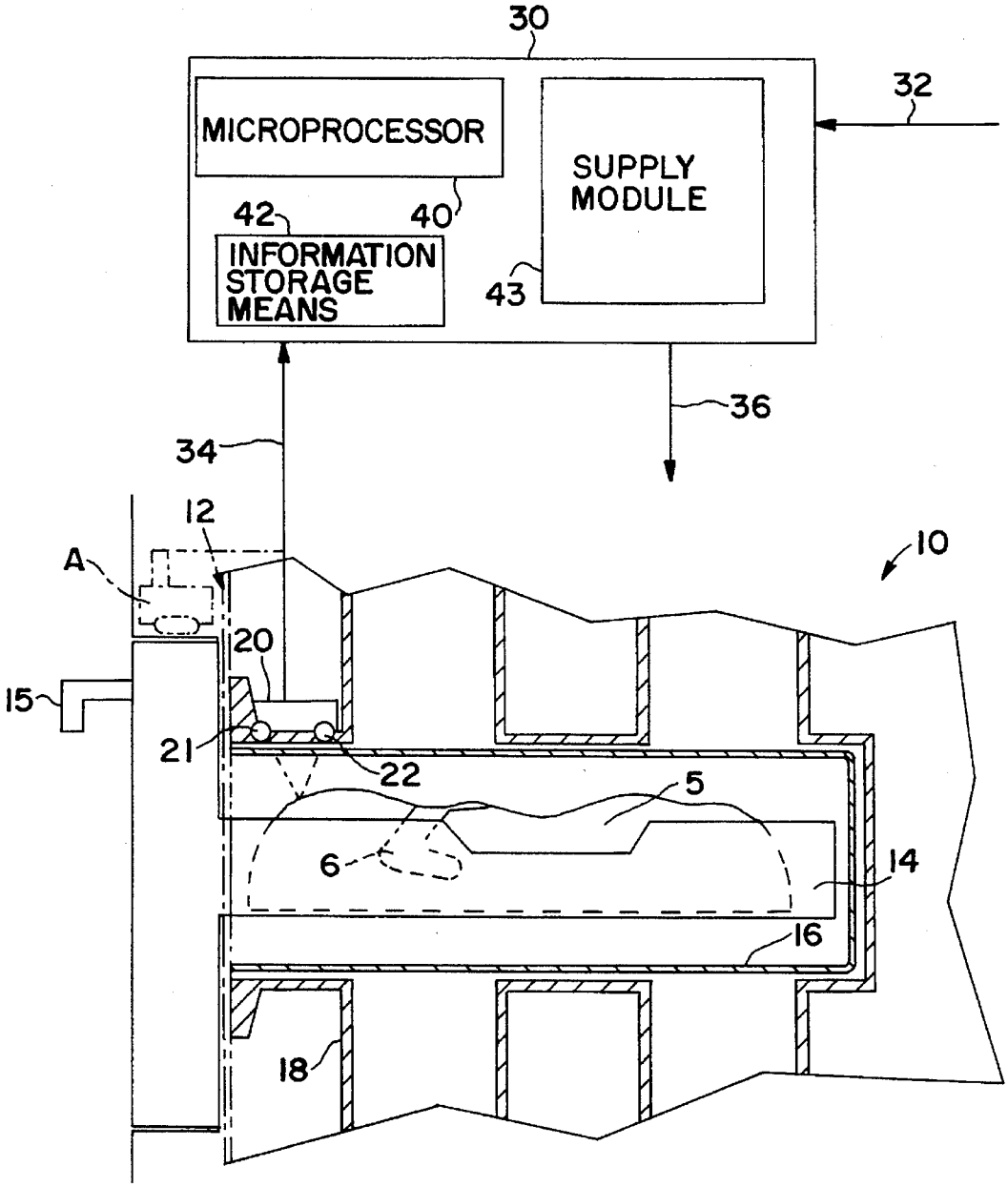
30
MICROPROCESSOR
SUPPLY MODULE
32
42
40
INFORMATION STORAGE MEANS
43
36
34
12
10
A
20
15
21
22
5
6
14
16
18

MICROWAVE OVEN WITH OPTICAL DETECTOR

BACKGROUND OF THE INVENTION

1. Field of the Invention

The present invention relates to a device for the control of the operation of a heating apparatus of a product in an enclosure, and more particularly of a heating or reheating apparatus for food products.

2. Description of the Related Art

In heating apparatus known at present, and particularly microwave ovens, the user must first set the duration and intensity of the desired heating by acting on buttons or pressure points located on a front panel. Satisfactory in the majority of the cases in which the user knows these parameters, either by experience, or by consulting tables, this device quickly becomes inadequate for heating apparatus located in public places at which various users will successively and rapidly heat very different products. Moreover, when the heating apparatus is installed in a public place, it must satisfy security standards, particularly as to thoughtless or even malevolent actions of certain users.

SUMMARY OF THE INVENTION

The object of the present invention is a control device for the operation of a heating apparatus of a product in an enclosure requiring minimum intervention of the user, preventing the onset of heating if the safety conditions are not satisfied while ensuring an exact heating sequence for very different products.

These objects are obtained thanks to a device comprising optical and/or optoelectronic means to read a distinctive sign inherent to the product or its packaging, a processing module comprising computer means to compare electric signals emitted from a reading of the distinctive sign with memorized reference values corresponding to the predetermined reference signs attributed to the product or to its packaging, and electronic or optoelectronic means to generate operational controls for the heating apparatus if the distinctive sign which is read corresponds to the reference signs.

Preferably, the control device will start the heating apparatus only if the distinctive sign which is read corresponds effectively to a memorized reference sign. Again preferably, the controls as to duration, intensity and spatial distribution of heating are established by the control device in a very exact way as a function of the memorized reference sign matched to the distinctive sign which is read.

Such a control device is applicable for heating apparatus using microwaves, or halogen or infrared lamps.

BRIEF DESCRIPTION OF THE DRAWING

The invention will be better understood from a study of an embodiment given by way of non-limiting example shown in the accompanying drawing representing in a schematic way a microwave device and the associated control device.

DESCRIPTION OF THE PREFERRED EMBODIMENT

The heating apparatus such as a microwave oven and shown generally by the numeral 10 comprises in a casing 12 an enclosure 16 in which can slide a drawer 14 actuated by means of a handle 15. The enclosure 16 is surrounded by a microwave guide device 18 permitting distributing in a uniform manner microwaves along the longitudinal axis of the enclosure 16. The microwave generator device, not shown, is supplied with electrical current by a line 36 from a processing module 30 itself supplied with line voltage from a line 32.

According to the invention, the product 5 to be reheated, or its packaging, has on its top at least one distinctive sign. This distinctive sign may be a series of black lines called a bar code, but for aesthetic reasons, it is preferred to have a distinctive sign integrated into a general advertising graphic assembly. For example, and as shown in the figure, the distinctive sign 6 is constituted by a letter C on the top of the packaging. The distinctive sign can also be the name or the graphic of the name of a manufacturing company of the product 5 to be reheated. Any other distinctive sign can also be used. Various geometric shapes can constitute a portion of the distinctive sign. These geometric shapes can be, for example, a square to define the duration of heating, a triangle to define the intensity of this heating and a circle to define the field of distribution of the heating.

In the illustrated example, the optical and/or optoelectronic means comprise an optoelectric infrared detector 20 comprising an emitter cell 21 and a receiver cell 22, said detector being located at the inlet and on the upper surface of the enclosure 16. For practical considerations, these cells 21 and 22 are in fact disposed behind a translucent portion of the enclosure 16. The optoelectronic detector receives the energy and transmits electric signals along line 34 to the processing module 30.

This processing module 30 comprises a microprocessor 40, computer means for storing information 42 accessible for reading and writing as well as a supply module 43. The information storage means 42, such as an EEPROM memory, can contain both the operational software of the processing module and the reference data. The microprocessor controls the supply module 43 to send along the line 36 electrical control orders controlling the starting, the intensity and/or the duration and/or the field of distribution of the microwave heating by the apparatus 10.

As will easily be understood in view of the above, the user pulls the drawer 14 out of the enclosure 16 by pulling on the handle 15 and positions on the drawer 14 the product 5 to be reheated. When the drawer is returned into the enclosure 16, the optoelectronic detector 20 is started by electrical means, such as for example an end-of-travel switch, which effects reading by the infrared receiver cell 22 of the upper surface of the product 5, or only a portion thereof. The image appearing in the reading window has thus been converted by the optoelectronic detector 20 into a digital image, which is to say a series of electrical signals transmitted along the line 34 to the processing module 30 at which these signals are first stored in a temporary memory contained in the information storage means 42.

The numerical treatment of this image can at first consist of an increase of the contrast to extract the contour of said numerized image, then a segmentation of the contour of the image by an analysis of the principal vectors forming the distinctive sign 6. Then the microprocessor, by appropriate algorithms, effects a comparison between certain segments of the processed numerical image and the segments of a reference image previously stored in the memory 42 and representing the distinctive sign. If no segment of the reference image is recognized, the control device decides the presence of an unknown object which can be either a dangerous object for the heating apparatus, such as a metallic object for a microwave oven, or a food product whose distinctive sign is unknown to the repertory stored in the memory. In this case, the microprocessor blocks the supply module 43, which prevents starting the heating apparatus 10. Conversely, when the segments of a memorized reference image are matched to the distinctive sign which is read, the microprocessor, once the recognition is validated, can extract from the EEPROM memory the exact values of duration, intensity and distribution of heat to be supplied, values which apply to the supply module 43 for the generation of electrical orders applied to the line 36 and then to the heating apparatus 10.

In another embodiment, the optical and/or optoelectronic means are constituted by a microcamera schematically shown at A by dashed lines in the figure. The microcamera comprises a C.C.D. (coupled charge device) cell and is positioned outside the cooking enclosure 16, so as to be situated above the drawer 14 when the latter is pulled out of the enclosure 16. The microcamera is, for example, a module JUA-585 of the SANYO company, ensuring an integrated infrared illumination (880 nM), the microcamera having a sensitivity of 0.1 Lux to 20 Lux. The microcamera ensures illumination and viewing of the distinctive sign inherent to the product or to its packaging. The analog image of said distinctive sign is then digitized and processed by the processing module 30 adapted to effect numerical processing and to emit the analysis of the image. In such an embodiment, when the drawer 14 is outside the enclosure 16 and the product 5 to be reheated is disposed on said drawer 14, the microcamera effects a viewing of the distinctive element present on the product 5. The image of the distinctive element is then processed by the module 30 as described above.

As will be understood from a reading of this explanation, the control device according to the invention frees the user of any technical consideration, which permits him to act more quickly. This device controls the heating apparatus in a very precise manner and ensures high security relative to errors of judgment, even malicious actions. Numerous improvements can be included in this device within the scope of this invention.

We claim:

1. Heating apparatus and control device therefor, said heating apparatus (10) comprising, in a housing (12) an enclosure (16) in which a drawer (14) that receives a product (5) to be heated is slidably mounted, said control device only being actuated after sliding said drawer (4) into said enclosure (16) by means of a handle (15) of said drawer (14) and comprising at least one of optical and optoelectronic means (21, 22) to read a distinctive sign (6) on one of the product (5) and a packaging of said product (5), a processing module (30) to compare signals generated from a reading of said distinctive sign (6) with predetermined reference signals memorized in a storage means, and means (43) for generating operational control signals for the heating apparatus (10) in response to a result of said comparison, said at least one of optical and optoelectronic means comprising a receiving cell (22) situated at an inlet and on an upper surface of the enclosure (16), said at least one of optical and optoelectronic means (43) only being energized when said drawer (14) has been pushed into said enclosure (16) to effectuate said reading of said distinctive sign (6).

2. Heating apparatus and control device therefor according to claim 1, wherein said receiving cell (22) is situated behind a translucent portion of said enclosure (16).

3. Heating apparatus and control device therefor according to claim 1, wherein said generating means (43) start the heating apparatus (10) only if said distinctive sign (6) which was read corresponds to a memorized reference sign.

4. Heating apparatus and control device therefor according to claim 3, wherein control of a duration and intensity of heating are established as a function of the memorized reference sign matched with said read distinctive sign (6).

5. Heating apparatus and control device therefor according to claim 3, wherein control of a spatial distribution of heating is established as a function of the memorized reference sign matched with said read distinctive sign (6).

6. Heating apparatus and control device therefor according to claim 1, wherein said processing module (30) comprises a microprocessor (40), means (42) for storing information of an EEPROM memory type, as well as a supply module (43), said microprocessor (40) being adapted particularly to effectuate a numerical processing of a digitized image of said distinctive sign (6) by comparing certain segments of said image of said distinctive sign (6) with segments of a reference image previously stored in said memory (42) so as to control the supply module (43).

7. Heating apparatus and control device therefor according to claim 1, wherein said heating apparatus comprises a microwave oven.

* * * * *